United States Patent [19]

Teixeira Soares

[11] 4,006,510

[45] Feb. 8, 1977

[54] SQUEEGEE

[75] Inventor: Barnabé Teixeira Soares, Sao Paulo, Brazil

[73] Assignee: Industrias Soares S/A. Borrachas e Metais, Sao Paulo, Brazil

[22] Filed: Aug. 25, 1975

[21] Appl. No.: 607,899

[30] Foreign Application Priority Data

Aug. 26, 1974 Brazil ..... 7064

[52] U.S. Cl. ..... 15/245; 15/250.4

[51] Int. Cl.[2] ..... B60S 1/04

[58] Field of Search ..... 15/245, 250.36–250.41

[56] References Cited

UNITED STATES PATENTS

| | | | |
|---|---|---|---|
| 269,793 | 12/1882 | Keene | 15/245 |
| 674,962 | 5/1901 | Cumming | 15/245 |
| 1,362,801 | 12/1920 | Johnson | 15/245 |
| 1,684,477 | 9/1928 | Demand | 15/250.36 |
| 1,853,715 | 4/1932 | Anderson | 15/250.36 |
| 2,230,489 | 2/1941 | Grossfeld et al. | 15/245 |
| 2,261,475 | 11/1941 | Kautenberg | 15/245 |
| 2,728,099 | 12/1955 | Cocco | 15/245 |
| 2,929,090 | 3/1960 | Grossfeld | 15/245 |

*Primary Examiner*—Peter Feldman
*Attorney, Agent, or Firm*—Toren, McGeady and Stanger

[57] ABSTRACT

A squeegee is constructed of a rectangular plate coated with rubber to form a rectangularly-shaped rubber coated body having an elongated working edge. The working edge has sloping side surfaces, in each of which a plurality of ribs extending parallel to the working edge are formed. The working edge, terminates in a thin, flexible rim or blade. A support handle for gripping the squeegee has a tubular shape and is secured to the rubber coated body along the edge opposite the working edge.

2 Claims, 4 Drawing Figures

SQUEEGEE

SUMMARY OF THE INVENTION

The present invention is directed to a squeegee of the type used in cleaning windows and similar surfaces.

The squeegee of the present invention is formed by coating or laminating a thin rectangular plate with rubber to provide a rubber body. The rubber body is also rectangular in shape, with an elongated working edge provided with sloping surfaces having parallel ribs formed in the sloping surfaces. Further, the working edge terminates in a thin flexible rim projecting outwardly from the sloping surfaces.

The structure of the squeegee of the present invention results in greater durability and improved operating efficiency over the squeegees of the prior art.

The various features of novelty which characterize the invention are pointed out with particularity in the claims annexed to and forming a part of this disclosure. For a better understanding of the invention, its operating advantages, and specific objects attained by its use, reference should be had to the accompanying drawings and descriptive matter in which there are illustrated and described preferred embodiments of the invention.

DETAILED DESCRIPTION OF THE INVENTION

Figure 1:
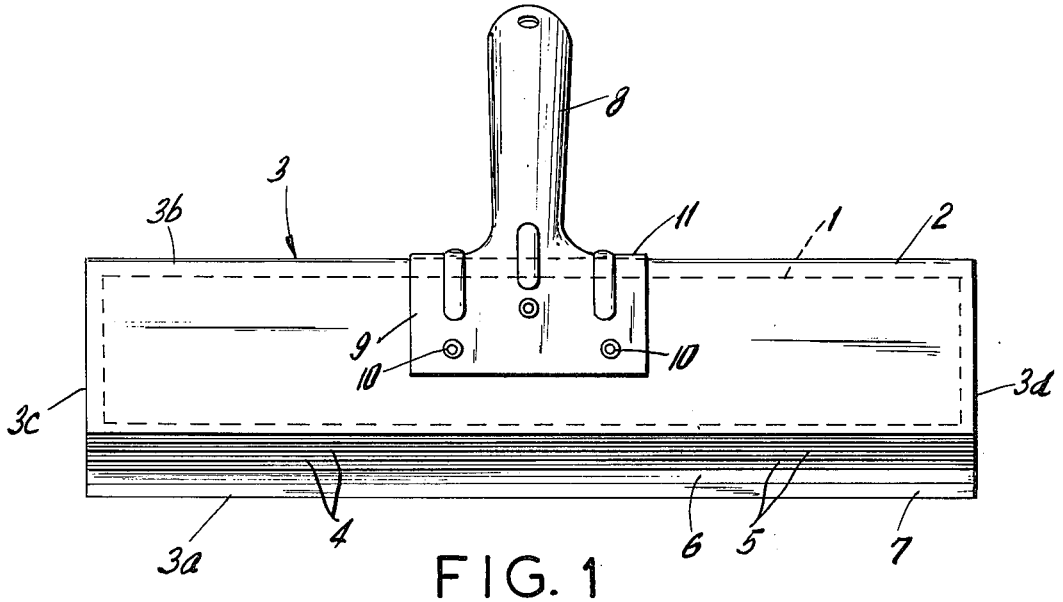
FIG. 1 is a view of one of the faces of a squeegee embodying the present invention.

In FIG. 1, a thin, elongated rectangular plate 1 is shown in phantom. The plate 1 is enclosed by a coating 2 of vulcanized rubber, or a similar material. The plate 1 and its rubber coating 2 together form a rectangular body 3 having two long edges 3*a*, 3*b* and two short edges 3*c*, and 3*d*. The long edge 3*a* forms a blade-like working edge which provides the squeegeeing action.

Figure 3:
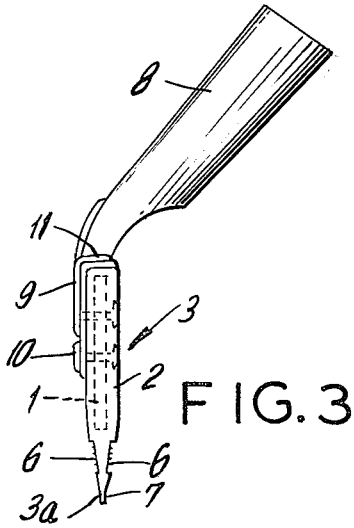
FIG. 3 is an elevational side view of the squeegee shown in FIG. 1.

As shown in FIG. 3, the working edge 3*a* is formed of the rubber coating 2 and projects outwardly from the plate 1.

Figure 4:
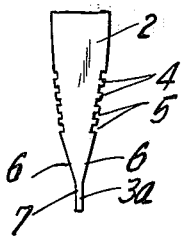
FIG. 4 is an enlarged partial side view of that part of the squeegee shown in FIG. 3.

As shown more clearly in FIG. 4, the blade-like working edge 3*a* consists of two tapering surfaces 6 converging as they extend outwardly from the plate 1 and a thin rim or blade 7 projecting from the narrower end of the surfaces 6. The opposite surfaces of the blade 7 are approximately parallel. Alternating thin ribs 4 and narrow grooves 5, generally rectangularly shaped in transverse section extend along the sloping surfaces 6 in parallel with the working edge 3*a*. Blade 7 because of its narrow width is more flexible than the remainder of the rubber coating 2 which makes up the working edge 3*a*. The sloping surfaces 6 along with their ribs 4 and grooves 5 afford adequate support for the blade 7.

Figure 2:
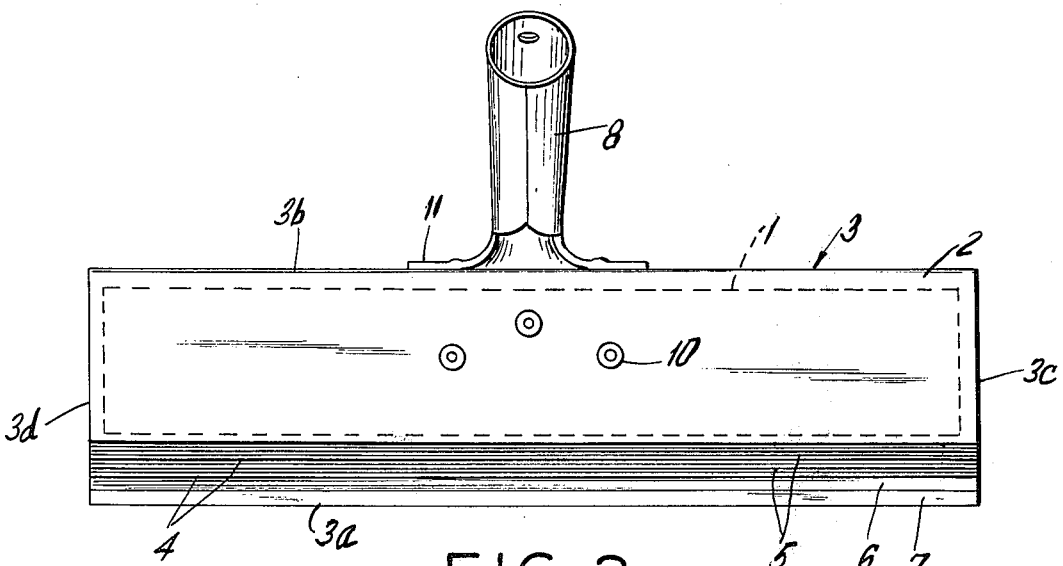
FIG. 2 is a plan view of the other face of the squeegee showing FIG. 1.

As illustrated in FIGS. 1, 2, and 3, a frusto-conically shaped tubular projection 8 forms a support handle for supporting the squeegee. The handle 8 is attached to the body 3 at the midway point along the long edge 3*b*. Extending from and integrally connected with the tubular projection 8 is a thin rectangular-shaped attaching plate 9. The plate 9 is positioned on one side of the body 3 and is secured to both the plate 1 and coating 2 by rivets 10 which pass through holes formed in the rubber body. Perpendicular to and integral with the attaching plate 9 is a bentover section 11 which bears against the edge 3*b* of the rectangular body.

The invention, in its essence, can be carried into effect in other forms which differ only in detail from that described above which has been provided only by way of example.

What is claimed is:

1. A squeegee comprising a thin, elongated rigid plate, a rubber-like coating completely enclosing said rigid plate having the same general shape as said rigid plate, said rubber-like coating forming a projection from one edge of said rigid plate and said projection forming a flexible working edge, said working edge comprising a tapered portion having a first face and a second face with said faces disposed in converging relationship as they project outwardly from said plate and a plurality of alternating parallel ribs and grooves generally rectangularly shaped in transverse section and formed in each of said first and second faces with said ribs and grooves extending parallel of said working edge, a thin flexible blade projecting outwardly from the narrower end of said tapered portion, the opposite surfaces of said blade extending outwardly from said tapered portion being disposed in parallel relation, and handle means connected to said rubber coating and said rigid plate.

2. A squeegee, according to claim 1, wherein said handle means comprises an attaching plate secured on one face of said rubber coating, a bent-over section perpendicular to and integral with said attaching plate and bearing on the edge of said rubber coating opposite said working edge, and a tubular projection secured to said plate and bent-over section and extending outwardly therefrom at an angle to said plate and forming a holding member for the squeegee.

* * * * *

UNITED STATES PATENT OFFICE

CERTIFICATE OF CORRECTION

Patent No. 4006510 Dated February 8, 1977

Inventor(s) Barnabe Teixeira Soares

It is certified that error appears in the above-identified patent and that said Letters Patent are hereby corrected as shown below:

In the heading of the Patent [73] should read as follows:

-- [73]Assignee: Industrias Soares S/A. Borrachas e Metais, Sao Paulo—SP, Brazil --.

Signed and Sealed this

Fourteenth Day of June 1977

[SEAL]

*Attest:*

RUTH C. MASON
*Attesting Officer*

C. MARSHALL DANN
*Commissioner of Patents and Trademarks*